US010796565B2

(12) United States Patent
Baek et al.

(10) Patent No.: US 10,796,565 B2
(45) Date of Patent: Oct. 6, 2020

(54) SAFETY INDICATOR TO PREVENT COLLISION BETWEEN PEDESTRIAN AND VEHICLE WHILE MAINTAINING SMOOTH TRAFFIC

(71) Applicant: KIDONG CO., LTD, Namyangju-si, Gyeonggi-do (KR)

(72) Inventors: Un-hoe Baek, Namyangju-si (KR); Bum-jin Kim, Chatsworth, CA (US)

(73) Assignee: KIDONG CO., LTD, Namyangju-si (KR)

( * ) Notice: Subject to any disclaimer, the term of this patent is extended or adjusted under 35 U.S.C. 154(b) by 0 days.

(21) Appl. No.: 16/682,464

(22) Filed: Nov. 13, 2019

(65) Prior Publication Data

US 2020/0152052 A1 May 14, 2020

(30) Foreign Application Priority Data

Nov. 13, 2018 (KR) ..... 10-2018-0138794

(51) Int. Cl.
*G08G 1/005* (2006.01)
*G08G 1/07* (2006.01)

(52) U.S. Cl.
CPC ..... *G08G 1/005* (2013.01); *G08G 1/07* (2013.01)

(58) Field of Classification Search
CPC ..... G08G 1/005; G08G 1/07; G08G 1/166; B60K 35/00; G06K 9/00805; B60W 50/14; B60W 2050/146
See application file for complete search history.

(56) References Cited

U.S. PATENT DOCUMENTS

| | | | | |
|---|---|---|---|---|
| 8,571,743 | B1 * | 10/2013 | Cullinane | G05D 1/00 701/23 |
| 10,403,142 | B1 * | 9/2019 | Shuff | G08G 1/07 |
| 2014/0032032 | A1 * | 1/2014 | Cullinane | B60W 30/18154 701/23 |
| 2018/0181091 | A1 * | 6/2018 | Funk | G08G 1/095 |
| 2020/0005634 | A1 * | 1/2020 | Shuff | G08G 1/005 |

FOREIGN PATENT DOCUMENTS

| | | | |
|---|---|---|---|
| JP | 2013-049992 | A | 3/2013 |
| JP | 3185192 | U | 8/2013 |
| KR | 10-1526355 | B1 | 6/2015 |

* cited by examiner

*Primary Examiner* — Orlando Bousono
(74) *Attorney, Agent, or Firm* — Jefferson IP Law, LLP

(57) ABSTRACT

A traffic island formed for smooth flows of vehicles and pedestrians is provided. More particularly, a plurality of safety indicators are installed around an entrance of the traffic island or around a crosswalk along a right turn lane to enable a vehicle turning right to recognize in advance a presence of a pedestrian at a corner, so that a collision risk between the pedestrian and the vehicle turning right is prevented while maintaining flows of vehicles smoothly.

3 Claims, 8 Drawing Sheets

SAFETY INDICATOR TO PREVENT COLLISION BETWEEN PEDESTRIAN AND VEHICLE WHILE MAINTAINING SMOOTH TRAFFIC

CROSS-REFERENCE TO RELATED APPLICATION(S)

This application is based on and claims priority under 35 U.S.C. § 119(a) of a Korean patent application number 10-2018-0138794, filed on Nov. 13, 2018, in the Korean Intellectual Property Office, the disclosure of which is incorporated by reference herein in its entirety.

BACKGROUND

1. Field

The disclosure relates to a safety indicator for smooth flows of vehicles and pedestrians. More particularly, the disclosure relates to a plurality of safety indicators that interwork after being independently installed around an entrance of a traffic island or around a crosswalk along a right turn lane so as to prevent a collision accident between a traveling vehicle and a pedestrian while maintaining a smooth flow of the vehicle.

2. Description of the Related Art

In general, in an intersection having a lot of vehicle movements and pedestrian movements, an island-shaped traffic island is formed at a corner portion spaced apart from boundary blocks at a predetermined distance (for example, a right turn lane).

Accordingly, pedestrians may easily and selectively move back and forth or right and left according to traffic lights installed on the traffic island, and the vehicle may be branched into a lane going straight and a lane turning right by the traffic island, in which a vehicle on the right turn lane may turn right at any time regardless of a vehicle on the straight lane, thereby implementing smooth flows of vehicles.

However, the traffic island has an inconvenience in that the pedestrian is required to cross the right turn lane away from a sidewalk to go to the traffic island, so there is a structural problem in which the pedestrian faces the vehicle on the right turn lane branched by the traffic island while crossing the right turn lane.

In other words, in a viewpoint of a driver of the vehicle intending to turn right, it is difficult to recognize the pedestrian because the pedestrian is located in a corner/dead zone. Particularly, since the vehicle is guided along a single path (the right turn lane) by the traffic island, there is a high risk of collision with the pedestrian when the vehicle moves at high speeds.

Further, since most vehicles travel on secluded roads at high speeds at night or at a crosswalk on a country road having little traffic, the risk of collision becomes even higher.

Accordingly, the Korea Road Traffic Authority has installed speed bumps to prevent the above accident and allows all vehicles passing through the lane to travel slowly. However, the speed bump installed around the crosswalk may cause a large-scale accident such as overturning when the vehicle discovers the speed bump late.

DOCUMENT OF RELATED ART (Non-Patent Document 1) http://news.jtbc.joins.com/article/article.aspx?news_id=NB 11299655

(Non-Patent Document 2) http://news.donga.com/3/all/20171108/87158300/1

(Non-Patent Document 3) https://news.sbs.co.kr/news/endPage.do?news_id=N1002982338

(Non-Patent Document 4) https://m.post.naver.com/viewer/postView.nhn7volumeNo=11102499&memberNo=35677972&vType=VERTICAL The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is direct to prevent an accident caused when a traveling vehicle and a pedestrian come into contact with each other upon facing each other around an entrance of a traffic island or around a crosswalk along a right turn lane.

Another aspect of the disclosure is to provide a diver of the vehicle is allowed to recognize a movement of the pedestrian in advance (that is, visibility increases) instead that the vehicle is forced to slow down (for example, a speed bump), so that the driver has a wide visual field and a relaxed attitude to sufficiently look around from a corner/long distance while driving slowly, thereby preventing a collision between the traveling vehicle and the pedestrian.

To this end, according to the disclosure, a plurality of posts erecting in the vertical direction are installed around an island-shaped traffic island or a crosswalk forming the right turn lane spaced apart from the sidewalk at a predetermined distance, each post is installed thereon with a photovoltaic cell for converting solar energy into electrical energy and with a battery for charging the electrical energy of the photovoltaic cell, and a controller configured to control a charge to the battery or a discharge to a movement display unit is installed between the battery and the photovoltaic cell and driven independently.

Additional aspects will be set forth in part in the description which follows and, in part, will be apparent from the description, or may be learned by practice of the presented embodiments.

In the above state, the movement display unit configured to output an on-off signal toward the traveling vehicle, and a button unit configured to instruct the movement display unit to output the on-off signal are installed to each of the posts.

In addition, the controller allows a neighboring safety indicator to output a simultaneous on-off signal while communicating with the safety indicator upon actuation of the button unit, and be switched into a standby state for charging while having a time-off upon a preset time.

Thus, when the pedestrian crosses the crosswalk after pressing the button unit, the movement display units simultaneously output the on-off signal toward the traveling vehicle, thereby enabling the traveling vehicle to recognize a presence of the pedestrian crossing the crosswalk, from a long distance/corner in advance, so that a collision accident is prevented while maintaining flows of vehicles smoothly.

Therefore, according to the disclosure, the driver of the traveling vehicle can recognize the presence of the pedestrian from a long distance/corner in advance by the safety indicators that interwork after being independently installed around the entrance of the traffic island or around the crosswalk along the right turn lane, so that the collision accidents between the traveling vehicle and the pedestrian can be reduced while maintaining flows of vehicles smoothly.

In addition, since each safety indicator can be installed independently while the charge and discharge are controlled by the controller installed between the photovoltaic cell and the battery that are installed on the post, the safety indicator according to the disclosure can be easily constructed without building a separate facility around the traffic island or crosswalk.

In addition, according to the disclosure, since the controllers of the safety indicators form multiple channels and interwork with each other, remaining safety indicators normally output an on-off signal even when any of the safety indicators does not operate due to a charge/discharge problem, so that the driver can be normally noticed of the presence of the pedestrian.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

The same reference numerals are used to represent the same elements throughout the drawings.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
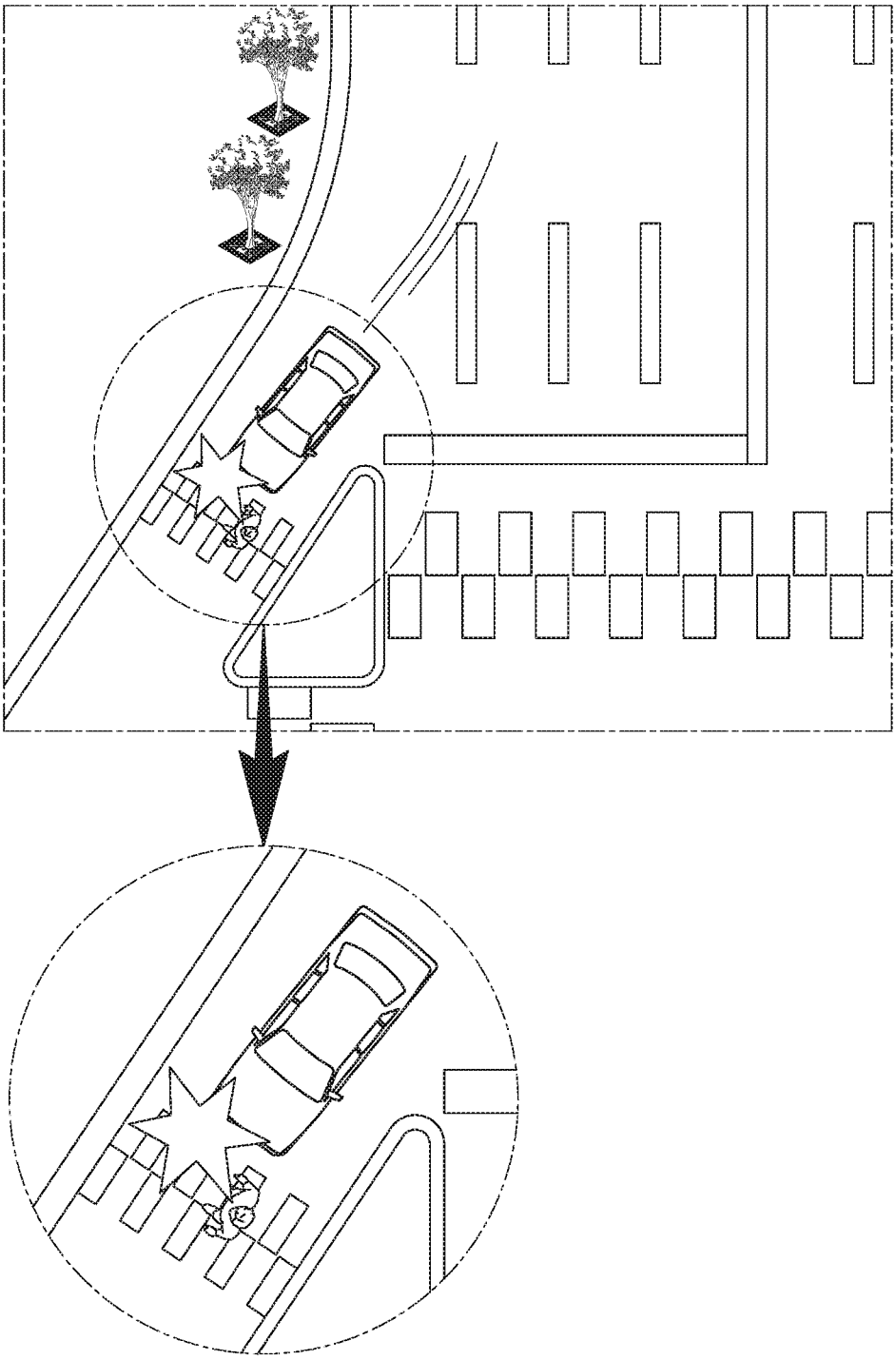
FIG. 1 is a view briefly illustrating a collision between a pedestrian and a right-turning vehicle due to a structural problem of a traffic island according to the related art.
Figure 2:
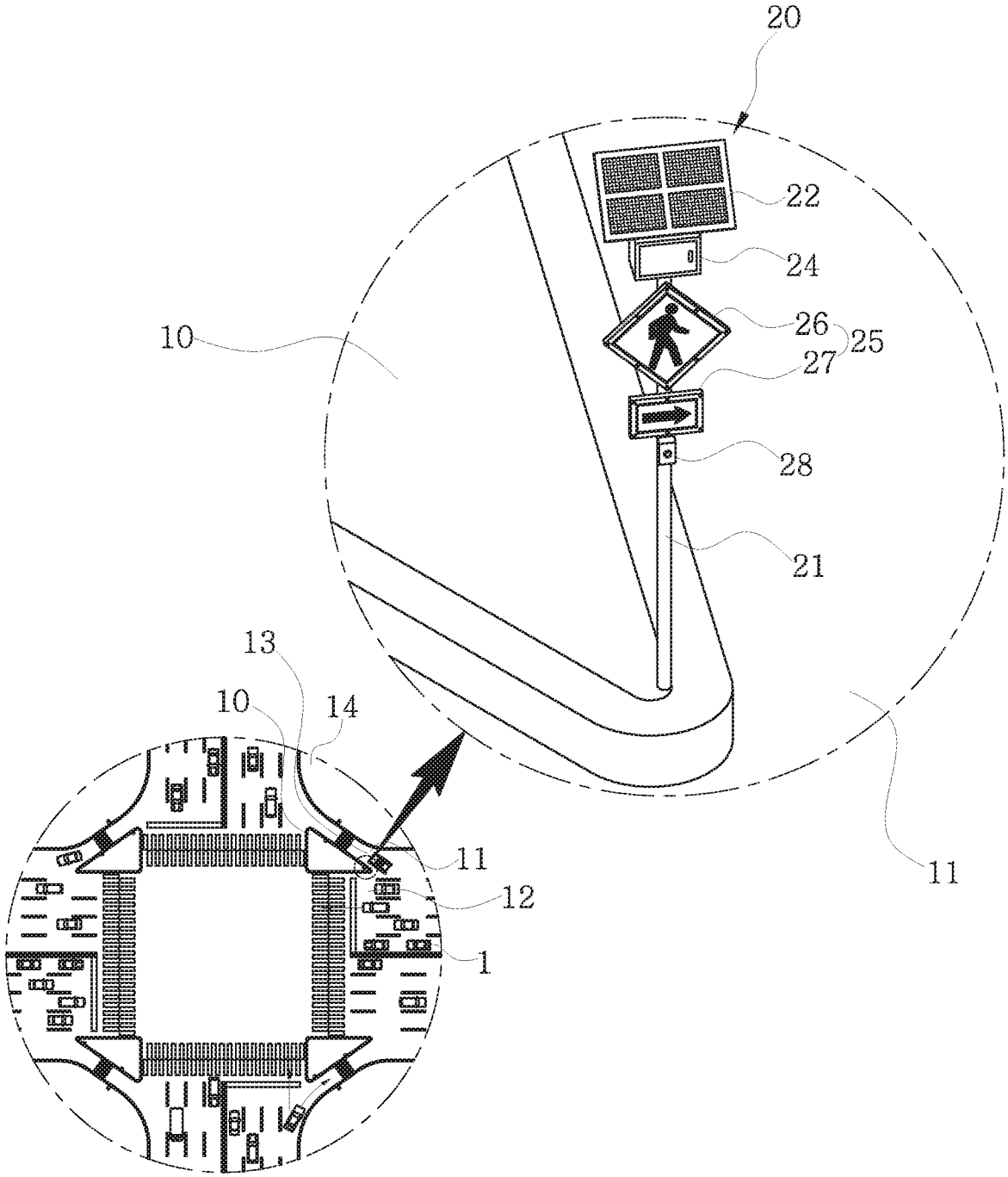
FIG. 2 is a perspective view showing an overall view of safety indicators installed on a traffic island according to an embodiment of the disclosure.

First, FIG. 2 is a perspective view briefly showing an overall view of safety indicators installed on a traffic island according to an embodiment of the disclosure.

Figure 3A:
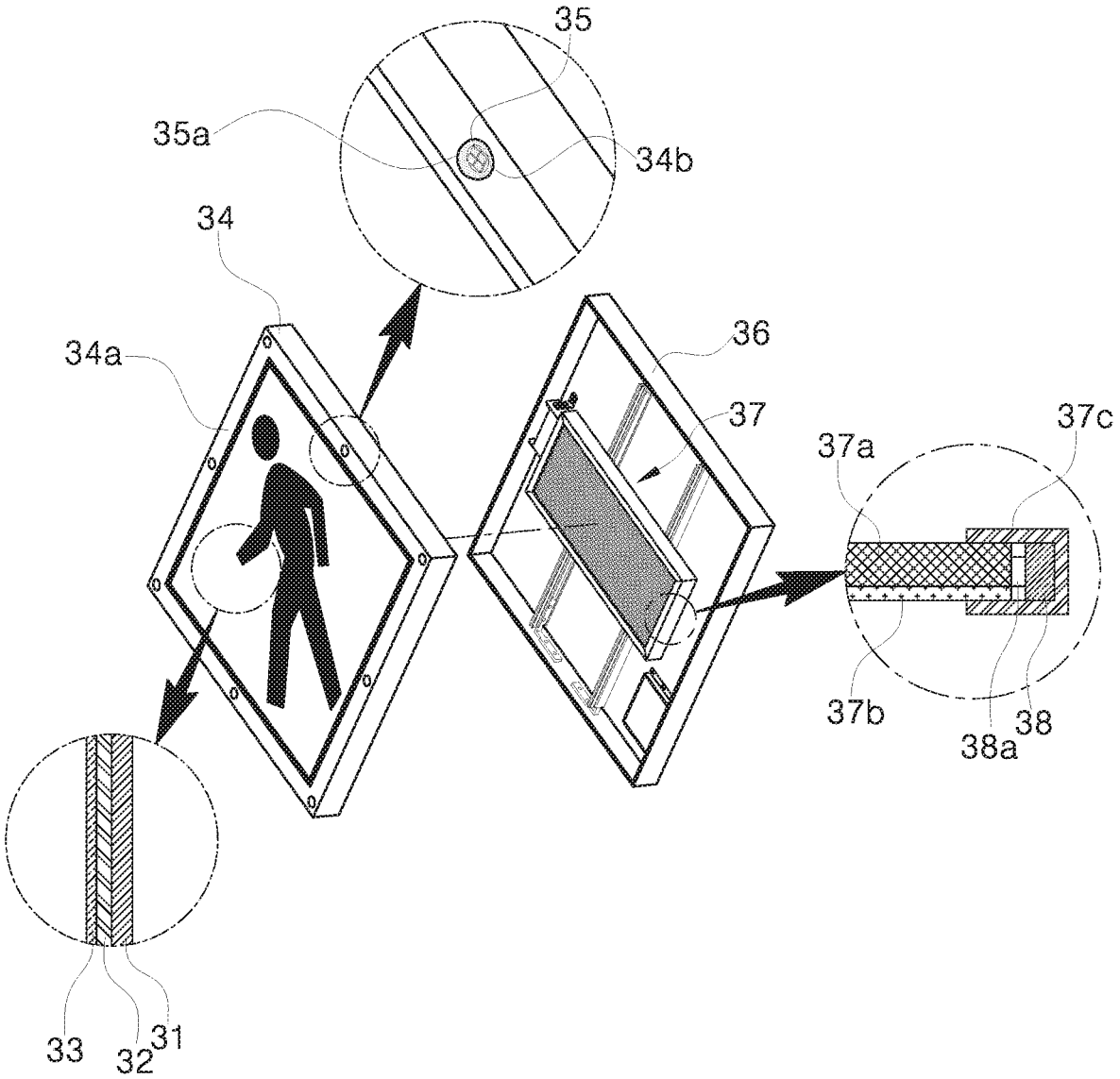
FIGS. 3A and 3B are exploded perspective views showing a configuration of a movement display unit of FIG. 2 according to various embodiments of the disclosure.
Figure 3B:
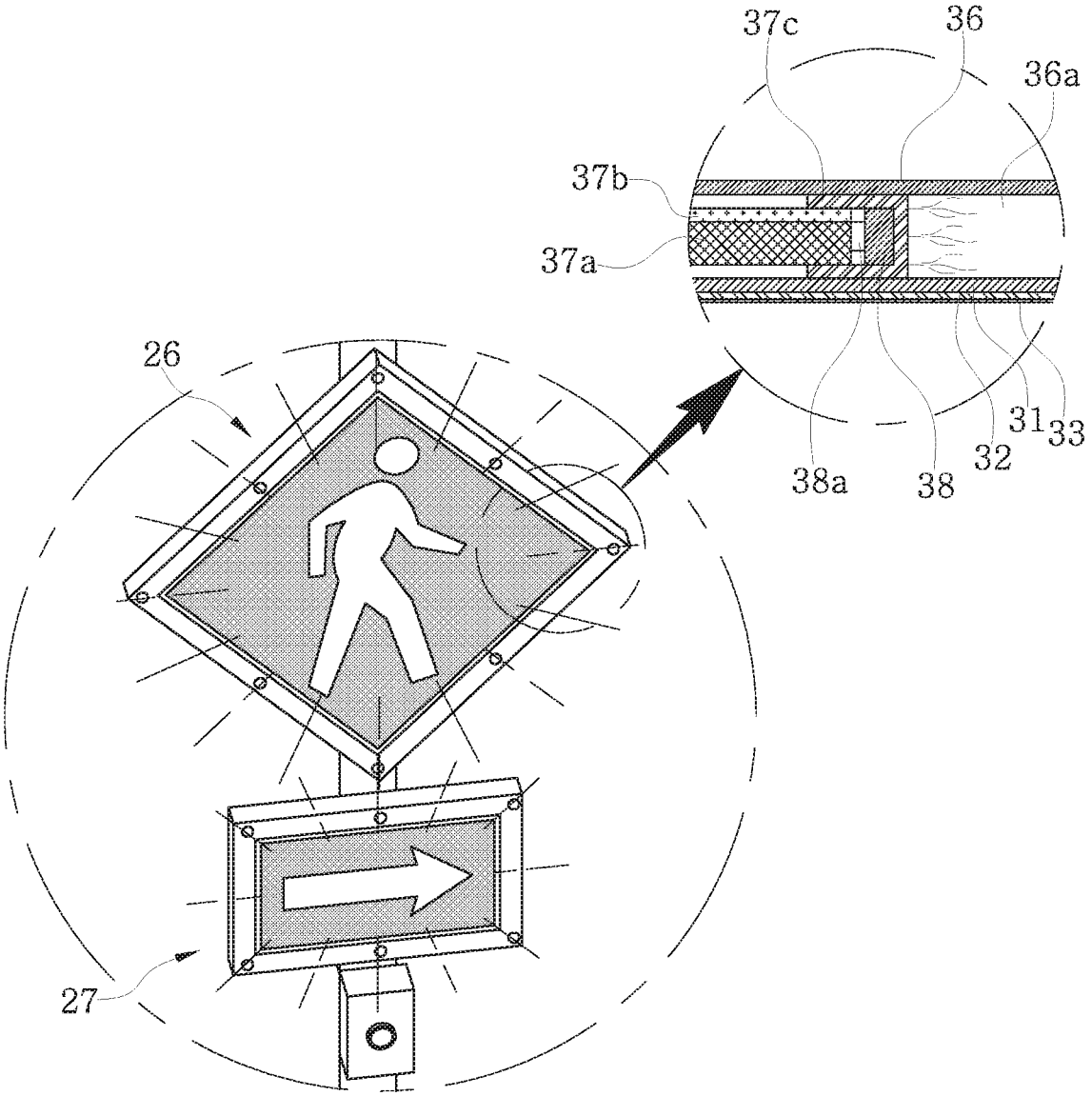

FIGS. 3A and 3B are exploded perspective views showing a configuration of a movement display unit in the safety indicator of FIG. 2 according to various embodiments of the disclosure.

Figure 4:
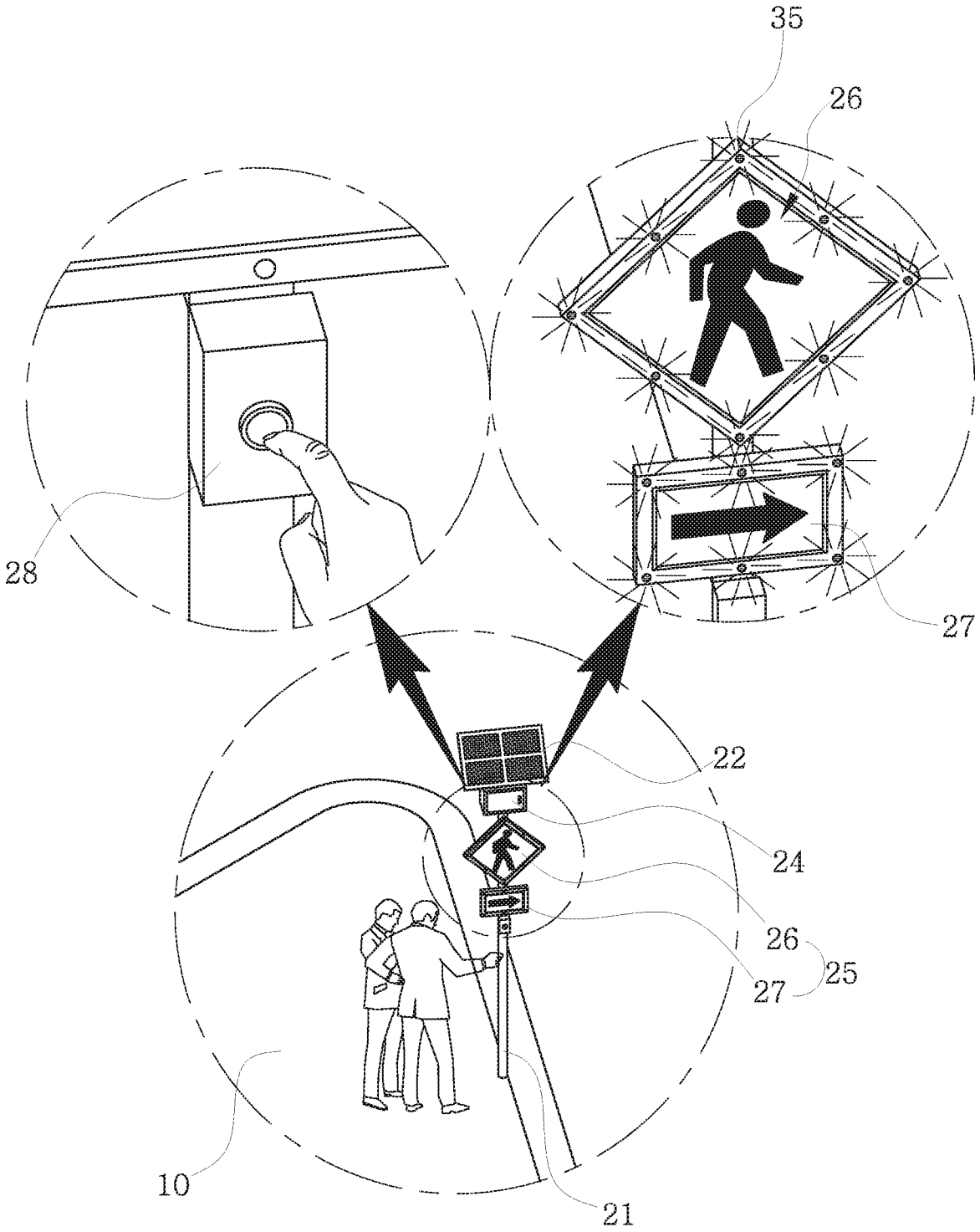
FIG. 4 is a block diagram showing a configuration of a controller of FIG. 2 according to an embodiment of the disclosure.

FIG. 4 is a block diagram showing a configuration of a controller in the safety indicator of FIG. 2 according to an embodiment of the disclosure.

Figure 5:
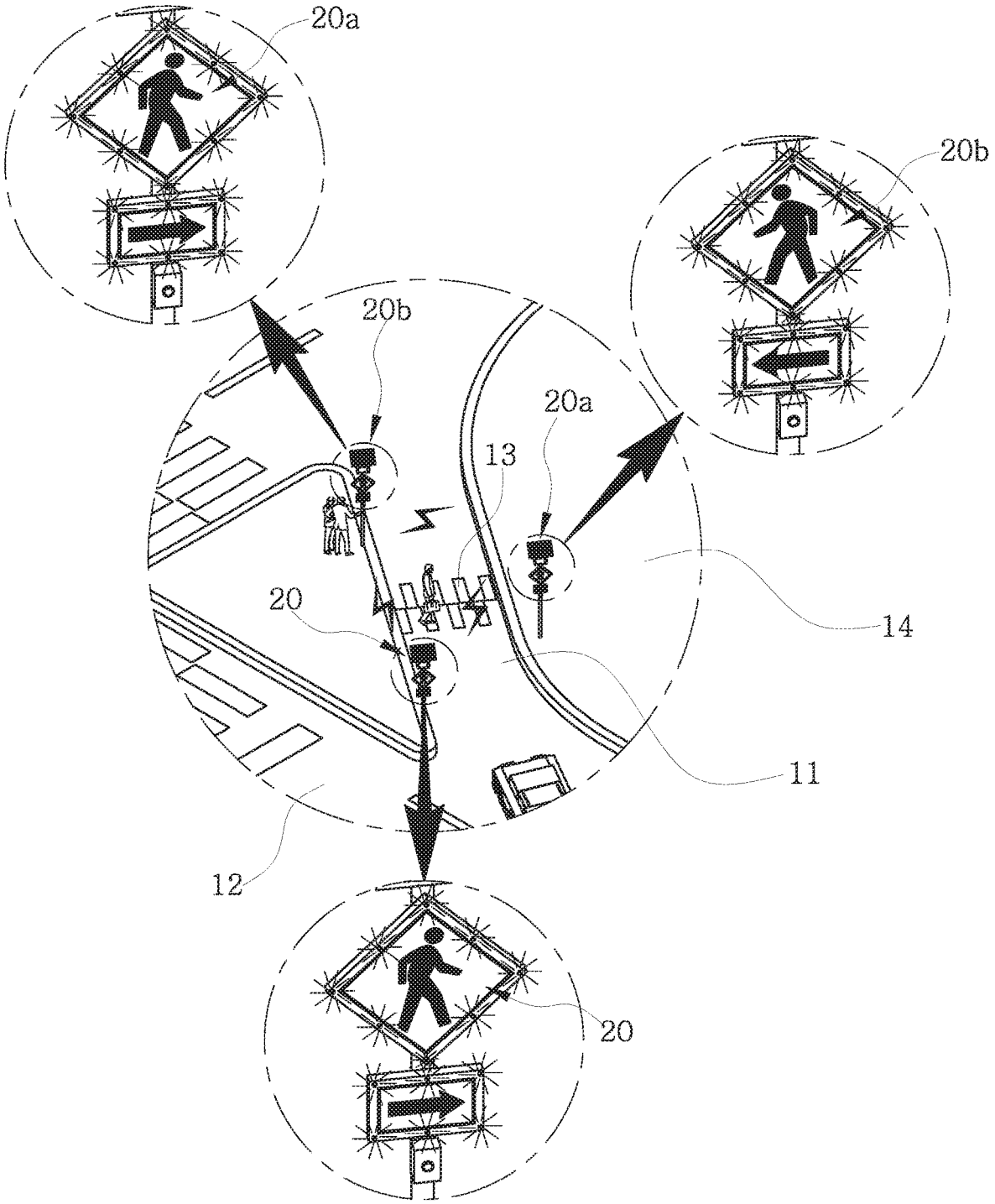
FIG. 5 is a flowchart showing operating process of safety indicators installed on a traffic island according to an embodiment of the disclosure.

FIG. 5 is a flowchart showing an operating process of the safety indicator installed on the traffic island according to an embodiment of the disclosure.

Figure 6:
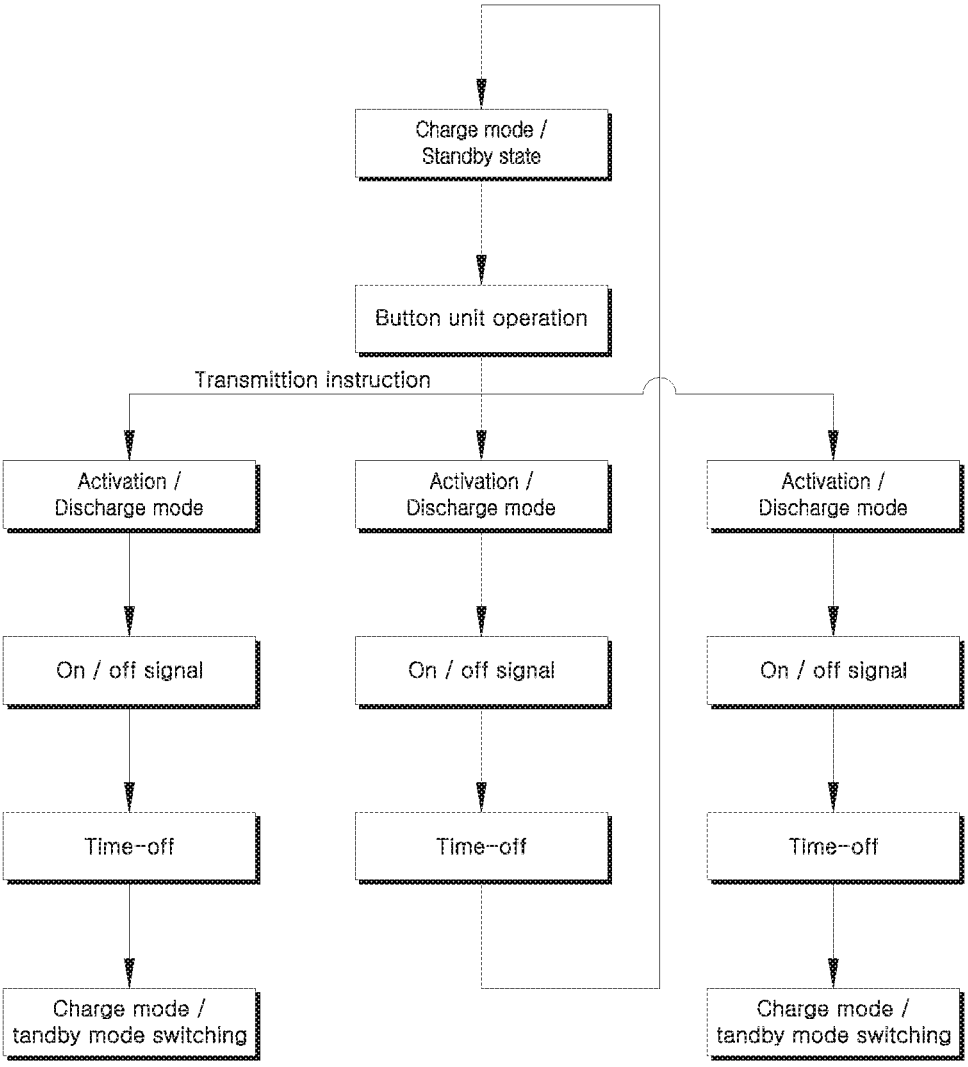
FIGS. 6 and 7 are views showing an operating state of a safety indicator on a traffic island according to various embodiments of the disclosure.
Figure 7:
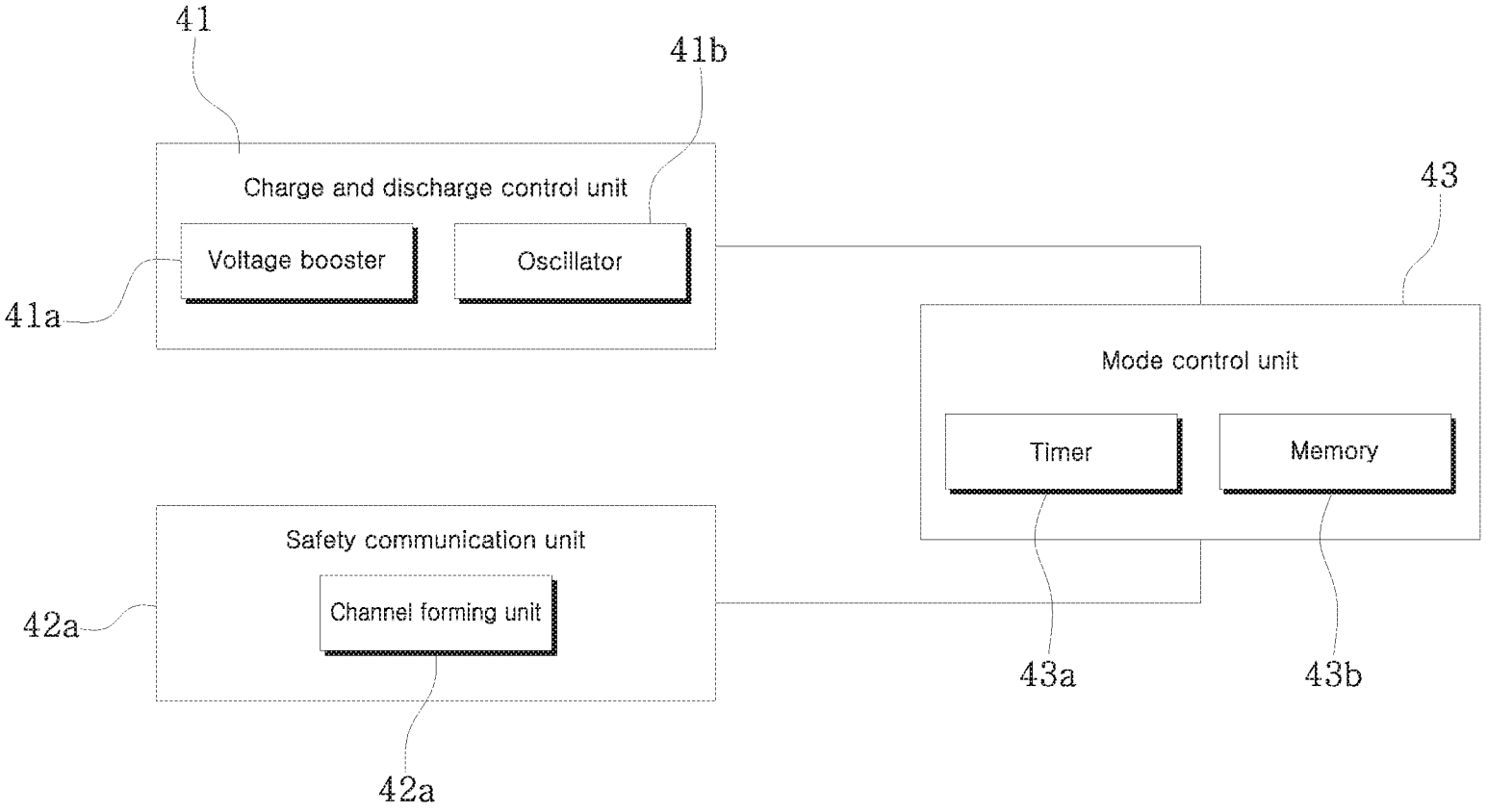

FIGS. 6 and 7 are views showing an operating state of the safety indicator on a traffic island according to various embodiments of the disclosure.

Referring to the above drawings, according to the disclosure, a right turn lane 11 spaced apart from a sidewalk 14 by a predetermined distance is formed in an intersection to allow a vehicle to turn right at any time regardless of a vehicle in a lane 12 going straight.

A crosswalk 13 is formed to connect the sidewalk 14 with a traffic island 10 at the island-shaped traffic island 10 constructed to enable smooth flows of vehicles. A plurality of safety indicators 20 are installed in the traffic island 10 or the crosswalk 13 to enable a driver of a vehicle 1 located at a far distance to recognize a presence of a pedestrian at a corner of the traffic island.

At this time, the crosswalk may connect the traffic island with the sidewalk. In some embodiments, the crosswalk may connect sidewalks.

In addition, the safety indicator 20 is an independent facility installed in addition to traffic lights and operated randomly.

After the post 21 erecting in the vertical direction is installed, the post is installed thereon with a photovoltaic cell 22 for converting solar energy into electrical energy, and with a battery 23 for charging the electrical energy of the photovoltaic cell, and a controller 24 configured to control a charge to the battery or a discharge to a movement display unit is installed between the battery and the photovoltaic cell so as to be independently driven.

In the above state, each of the posts 21 is provided with the movement display unit 25 for outputting an on-off signal in the direction of forming the right turn lane 11, and provided with a button unit 28 for instructing the movement display unit to output the on-off signal.

In addition, the controller 24 is configured to allow neighboring safety indicators 20*a* and 20*b* to output a simultaneous on-off signal while interworking with the safety indicators upon actuation of the button unit, and be switched into a standby state while having a time-off upon a preset time.

Thus, when the pedestrian crosses the crosswalk 13 after pressing the button unit 28, the movement indicators of the safety indicators 20, 20*a* and 20*b* installed along the right turn lane 11 output the on-off signal toward the right turn lane 11, the vehicle 1 entering the right turn lane or driving vehicle sees the on-off signal, recognizes in advance that a person is crossing the crosswalk 13, and drives slowly, so that a collision accident with the pedestrian can be prevented.

At this time, the safety indicator 20 and 20*a* are installed on one side and the other side around the crosswalk 13, and in some embodiments, further installed along the entrance to the traffic island 10 or along the right turn lane.

The movement display unit 25 installed on each post may be installed toward a direction in which the lane is defined so as to be easily exposed to the driver's view of the traveling vehicle.

In addition, the movement display unit 25 is divided into a display part 26 for indicating a presence of the crosswalk and a movement part 27 for displaying a moving direction.

The display part 26 and the moving part 27 are configured to have a board 31 having a polygonal or circular shape, a reflective sheet 32 having a shape corresponding to the board and attached to the board, and an EC film 33 having a specific symbol, pattern or character is attached to the reflective sheet, so that reflected/scattered light is exposed to the driver's view when the traveling vehicle 1 emits the light, and thus the movement direction or a presence of the crosswalk indicated from the EC film 33 formed on the board 31 can be easily recognized.

The board 31 may be formed of a material durable to sufficiently withstand temperature changes and vibrations. Particularly, the board 31 may be mounted inside an upper case 34 formed in a center thereof with an opening.

In addition, a plurality of through-holes 34*a* are formed at a periphery of the upper case 34 at regular intervals, and light emitting diodes (LEDs) 35 having the diffusion lenses 35*a* are fixed to and protrude from the through-holes 34*b*, respectively, in which each LED 35 is connected to a printed circuit board mounted in an inner space 36*a* of a lower case 36 engaged and assembled with the upper case 34, such that the LEDs 35 having the diffusion lenses 35*a* simultaneously output the on-off signal at regular time intervals to allow the driver to react regardless of day or night.

At this time, the on-off signal may be turned on and off by the printed circuit board at a rate of 0.8 m/s in proportional to a distance of the crosswalk corresponding to a walking speed of a mobility-handicapped person. In the embodiments, the on-off signal may be outputted at a rate of 1 m/s for about 5 to about 10 seconds.

For the reference, in the embodiments, the printed circuit board mounted in the inner space of the lower case 36 may be mounted inside the lower case in a modular state with separate LEDs so as to surface-emit light with uniform brightness.

In other words, as shown in FIGS. 3A and 3B, the LED module 37 may be configured such that, after a printed circuit board 38 installed thereon with a plurality of LEDs 38*a* at regular intervals is mounted to be disposed in a lateral direction inside a polygonal metal edge frame 37*c* having an inner space, a transparent or translucent light guide plate 37*a* having a predetermined thickness and having a rear end attached to a reflective sheet 37*b* is mounted to the inner space, and thus light is surface-emitted forward through the reflective sheet 37*b* when the LEDs 38*a* mounted inside the edge frame 37*c* emit the light in the lateral direction, so that a figure, character, or symbol formed on the boards of the display part 26 or the movement part 27 may be clearly identified without blurring due to a lightness difference or color difference.

The edge frame 37*c* is configured to fix the printed circuit board 38 and the light guide plate 37*a*, to which the reflective sheet 37*b* is attached, that are located inside the edge frame 37*c*, and configured to disperse heat of the LEDs 38*a* installed therein to the outside, thereby filling the heat in the inner space 36*a* of the lower case 36.

Thus, moisture or dew on the EC film 33 or the reflective sheet 32 of the board 31 mounted at the opening of the upper case 34 is minimized at night, so that recognizability may be prevented from deteriorating.

At this time, operations of the movement display unit may be switched according to changes of day and night. In other words, for easy identification by the driver, the on-off signal is outputted during daytime, and surface-emission is performed during night.

In addition, the button unit 28 is configured to inform the driver of a movement of the pedestrian at a corner/dead zone after the pedestrian presses the button. In some embodiments, a sensor unit 29 may be further provided to allow the on-off signal to operate automatically when the pedestrian moves.

After a detection section is formed on bottoms of the sidewalk and the traffic island 10 around the crosswalk 13 to form a line pattern having a predetermined shape, the sensor unit 29 is configured to detect, through an infrared sensor or a camera, the movement when the pedestrian in the corresponding detection section is located on the sidewalk 14 and moves to the sidewalk 13, automatically output the on-off signal even when a blind or general pedestrian does not operate the inconvenient button, and allow the driver in the right turning vehicle to recognize the presence of the pedestrian crossing a crosswalk at the corner.

In addition, the controller 24 is a device installed between the battery 23 and the photovoltaic cell 22 to enable electrical energy of the photovoltaic cell to be charged to the battery 23 or, on the contrary, enable power of the battery to be applied to the movement display unit 25, and control to interwork with the neighboring safety indicators 20, 20*a*, and 20*b* so as to enable the simultaneous on-off signal to be outputted for a predetermined time.

In addition, the controller 24 includes a charge and discharge control unit 41 configured to control the charge or discharge, a safety communication unit 42 configured to interwork with the neighboring safety indicators, and a mode control unit 43 configured to control the charge and discharge control unit and the safety communication unit to perform designated operations.

The charge and discharge control unit 41 allows the battery to be charged with the power applied from the photovoltaic cell while preventing over-charge or over-discharge, and applies the power of the battery to the movement display unit after receiving an instruction of the mode control unit 43.

Further, in order to increase the charging efficiency, the charge and discharge control unit 41 allows a voltage booster 41*a* to boost the voltage into a charging voltage or more during a low voltage state upon photovoltaic charging, and thus power of the photovoltaic cell at a reference value or less may be also charged to the battery, and the power is pulse-inputted to the battery 23 by an oscillator 41*b*, so that the power also may be charged quickly without damage to a lifetime of the battery.

In addition, the safety communication unit 42 is configured to activate the neighboring safety indicator in a standby status to output the simultaneous on-off signal.

Particularly, the safety communication unit 42 is configured to form a mesh network with the neighboring safety indicators 20, 20*a* and 20*b* through a channel forming unit 42*a*, so that all other safety indicators normally output the on-off signal even when any of the safety indicators being in the standby state does not operated due to a charge/discharge problem.

In addition, the mode control unit 43 is configured to maintain a charge mode at normal situations and be activated and switched into a discharge mode when the button 28 is pressed by the pedestrian, and configured to control the safety communication unit 42 and the charge and discharge control unit 41 to perform the designated operations.

The mode control unit 43 controls the charge and discharge control unit 41 to apply the set power to the movement display unit 25 so as to output the on-off signal, controls the safety communication unit 42 to transmit an instruction to the neighboring safety indicator being in the standby state, such that all of the safety indicator are activated and operated in the discharge mode, controls each of the safety indicators 20, 20*a* and 20*b* to output the on-off signal simultaneously.

In addition, the mode control unit 43 includes a timer 43*a* and a memory 43*b*, and is configured to have a time-off when a set time elapses after outputting the on-off signal, and thus the operation stops and switched into the standby state and operated in the charge mode.

Therefore, according to the disclosure, the plurality of safety indicators 20, 20*a* and 20*b* are installed around an entrance of the traffic island 10 or around a crosswalk along a right turn lane to allow the driver of the vehicle to recognize the presence of the pedestrian at the corner before entering the right turn lane, so that the collision accidents between the traveling vehicle and the pedestrian can be reduced while maintaining flows of vehicles smoothly.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A plurality of safety indicators comprising:

a plurality of posts installed in a vertical direction around an island-shaped traffic island spaced apart from a sidewalk at a predetermined distance to form a right turn lane or installed around a crosswalk;

a photovoltaic cell provided on each post for converting solar energy into electrical energy;

a battery provided on each post for storing the electrical energy of the photovoltaic cell;

a controller provided on each post and installed between the battery and the photovoltaic cell to control a charge to the battery or a discharge to a movement display unit;

the movement display unit provided on each post to output an on-off signal toward a traveling vehicle based on power supplied through the controller; and a button unit provided on each post to instruct an operation of the movement display unit;

wherein the controller of each safety indicator includes:

a charge and discharge control unit configured to allow the battery to be charged with power applied from the photovoltaic cell while preventing over-charge or over-discharge, and apply the power of the battery to the movement display unit upon receiving an instruction from a mode control unit;

a safety communication unit configured to activate the safety indicator which is maintained in a charge mode by the instruction of the mode control unit;

wherein the mode control unit is further configured to control the safety communication unit to activate a neighboring safety indicator to control the plurality of safety indicators to simultaneously output the on-off signal, and configured to be automatically powered-off when a predetermined time elapses to stop an operation thereof in order to maintain the safety indicators in a standby mode;

wherein the movement display unit of each safety indicator includes:

an upper case, in which a board attached with an electrochromic (EC) film is exposed through an opening formed at a center of the upper case;

light emitting diode (LED) installed at the upper case and turned on and off through a through-hole formed in an edge of the upper case; and a lower case;

wherein when the upper case is engaged and assembled with the lower case, a printed circuit board on which a plurality of LEDs are installed at regular intervals is provided inside a metal edge frame so as to be disposed in a lateral direction in an inner space between the upper case and the lower case; and an LED module with a transparent or translucent light guide plate, which has a predetermined thickness and is provided at a rear end thereof with a reflective sheet, the LED module being installed inside the inner space;

wherein the movement display unit is configured to surface-emit light with uniform brightness by the LED module installed inside the inner space, and heat irradiated from the LED module is filled in the inner space so that recognizability is prevented from deteriorating.

2. The safety indicator of claim 1, wherein the on-off signal is turned on and off at a rate of 0.8 m/s in proportion to a distance of the crosswalk corresponding to a walking speed of a mobility-handicapped person.

3. The safety indicator of claim 1, wherein the charge and discharge control unit includes:

a voltage booster configured to boost a voltage of the photovoltaic cell to a charging voltage or more when the power of the photovoltaic cell has a value equal to or less than a charging voltage of the battery, so that even power at a reference value or less is applied to the battery and charged; and an oscillator configured to oscillate the power applied to the battery so as to be pulse-inputted, wherein the safety communication unit includes a channel forming unit configured to form a mesh network with the safety indicators such that all remaining safety indicators output the on-off signal even when any of the safety indicators being in the standby mode is inoperable due to a charge/discharge problem.

* * * * *